US006655876B2

(12) United States Patent
Spaulding et al.

(10) Patent No.: US 6,655,876 B2
(45) Date of Patent: Dec. 2, 2003

(54) METHOD OF COMPACTED STONE COLUMN CONSTRUCTION

(75) Inventors: Charles Anthony Spaulding, Costa Mesa, CA (US); Scott Sorenson, LaQuinta, CA (US)

(73) Assignee: Menard Soil Treatment, Inc., Orange, CA (US)

( * ) Notice: Subject to any disclaimer, the term of this patent is extended or adjusted under 35 U.S.C. 154(b) by 0 days.

(21) Appl. No.: 10/080,091

(22) Filed: Feb. 21, 2002

(65) Prior Publication Data

US 2003/0156907 A1 Aug. 21, 2003

(51) Int. Cl.[7] ..... E02D 7/00
(52) U.S. Cl. ..... 405/232; 405/50
(58) Field of Search ..... 405/50, 231, 232, 405/271, 233

(56) References Cited

U.S. PATENT DOCUMENTS

| | | | | |
|---|---|---|---|---|
| 2,667,749 A | | 2/1954 | Steuerman | |
| 4,126,007 A | * | 11/1978 | Mars | 405/271 |
| 4,397,588 A | | 8/1983 | Goughnour | |
| 4,721,055 A | * | 1/1988 | Pado | 405/191 |
| 5,256,003 A | * | 10/1993 | Ito et al. | 405/232 |
| 5,279,502 A | | 1/1994 | Goughnour | |
| 5,932,290 A | | 8/1999 | Lombardi et al. | |

OTHER PUBLICATIONS

Elias, V., Welsh, J., Warren, J., Lukas, R., (1998). Demonstration Project 116, Ground Improvement Technical Summaries, Chapter 7: Stone Columns. Publication No. FHWA–SA–98–068R.

* cited by examiner

*Primary Examiner*—Heather Shackelford
*Assistant Examiner*—Lisa M Saldano
(74) *Attorney, Agent, or Firm*—Banner & Witcoff, Ltd.

(57) ABSTRACT

Compacted granular or stone columns are constructed in soil to increase the load-bearing capacities or drainage capabilities of the native soil. A vibratory probe is penetrated down into the soil to the desired depth. As the probe is incrementally withdrawn, the cavity is filled with granular material that is compacted in place by the probe. Granular material is transported directly to the tip of the probe through a transfer pipe running along the length of the probe. A material container located at the top of the probe mechanism contains the granular material that feeds the transfer pipe. The rate and quantity of flow of the granular material from the material container is visually monitored in real-time by the operator on a closed-circuit television monitor so that the construction process can continue uninterrupted and the operator can adjust the contents of the material container according to the in situ soil response.

13 Claims, 4 Drawing Sheets

METHOD OF COMPACTED STONE COLUMN CONSTRUCTION

FIELD OF INVENTION

The present invention relates generally to improvements to the method of construction of compacted granular or stone columns in soil masses.

BACKGROUND OF THE INVENTION

Stone columns are columns of compacted granular material installed in soil for the purpose of improving the soil characteristics. Stone columns improve drainage in fine grained soil deposits and increase load bearing capacity to a point where considerably larger bearing stresses may be sustained without developing detrimental or excessive settlement or bearing capacity failure.

Stone columns, as the name implies, are vertical columns of compacted crushed stone, gravel or sand which extend through a deposit of soft material or soil to be strengthened. A number of acceptable methods are available for installing such compacted granular columns or stone columns. Examples of such prior art are disclosed in Mars U.S. Pat. No. 4,126,007 and in Goughnour U.S. Pat. No. 4,397,588.

Vibratory probes are typically utilized to construct a sand or stone column, the probe itself generally consisting of a 12 to 16 inch diameter hollow cylindrical body. A down-hole vibrator capable of providing a minimum of 130 kW and a minimum centrifugal force of 210 kN of force gyrating about a longitudinal axis is typically used to create lateral vibrations in the probe, i.e., vibrations in the horizontal plane. The minimum double amplitude (peak to peak measurement) of the probe tip is not less than 18 mm in a horizontal direction when the probe is in a free suspended position. In addition to the probe, there are follower tubes, electric cables, and/or hydraulic hoses and water hoses are connected usually to the uppermost extension tube. The complete assembly is usually supported from a commercial crane.

In order to construct a stone column with this type of probe, the probe is penetrated into the soil to a predetermined depth under its own weight and with vibration and assistance of a jetting fluid. The jetting fluid may be water under pressure or compressed air. At the required depth, the probe is slowly retrieved in 1 ft. to 2 ft. increments to allow backfill placement under the withdrawn tip of the probe. Granular material is transported to the probe tip through a transfer pipe that runs parallel to the probe down to the tip; in the industry, this is referred to as the bottom feed method. The transfer pipe is fed by a material container, typically mounted at the top of the probe assembly. As the probe is withdrawn, the granular material is fed into the void at the probe tip. The probe is partially lowered again, forcing the freshly deposited granular material into the surrounding soil with the assistance of vibration, thereby creating compaction. The ratio between the steps of extraction and re-driving governs the final cross section of the stone column. By repetition of these steps, the stone column is gradually constructed.

A problem that is frequently encountered in the current bottom feed method of stone column construction is the loss of continuous flow of granular material through the transfer pipe. The loss of flow has a number of detrimental aspects that are caused by the operator's removal of the vibratory probe from the soil in order to determine if the flow is interrupted. In fully removing the vibratory probe, the construction of the stone column becomes time-inefficient. Another detrimental effect is that the construction of a uniform, well-compacted stone column is hindered.

BRIEF SUMMARY OF THE INVENTION

The present invention overcomes the prior art deficiencies and improves the construction procedure by allowing the operator to continuously monitor the flow of material to the stone column thus guaranteeing a continuous stone column formation process in the most time-efficient manner. An object of the present invention is to provide the equipment operator real-time visual information on the flow of granular material conveyed from the material container into the stone column and monitor whether any granular material is left in the material container. Based on the visual information, the operator can control the stone column installation procedure, specifically the lifting and re-compaction phases without interruption in the flow of granular material.

This new system gives a qualitative assessment of the quantity of granular material remaining in the material container and the flow rate of stones conveyed through the transfer pipe and into the stone column. There are several advantages to real-time visual monitoring. The following are illustrative, but not exhaustive.

First, the operator knows if stones are actually flowing and does not need to lift the probe completely out of the ground for examination; this provides an efficiency gain in time and a reduction in effort. Second, the operator can control the rate of flow of granular material. Because stone placement varies according to soil response (soil response depends on such disparate factors as fines content, plasticity, water table level, etc.), an operator can continuously control and adjust the placement procedure by, for example, adapting the lifting speed, lift increment, or number of increments. Finally, as the stone column should be continuous and of only the minimum diameter specified, the method enables the operator to more efficiently reach this objective. A roughly 20% increase in average productivity over the construction of 200 columns has been measured.

Other objects and advantages appear in the following description and claims.

BRIEF DESCRIPTION OF THE SEVERAL VIEW OF THE DRAWING

The accompanying drawings show, for the purpose of exemplification without limiting the invention or the claims thereto, certain practical embodiments illustrating the principles of this invention wherein:

DETAILED DESCRIPTION OF THE INVENTION

Figure 1:
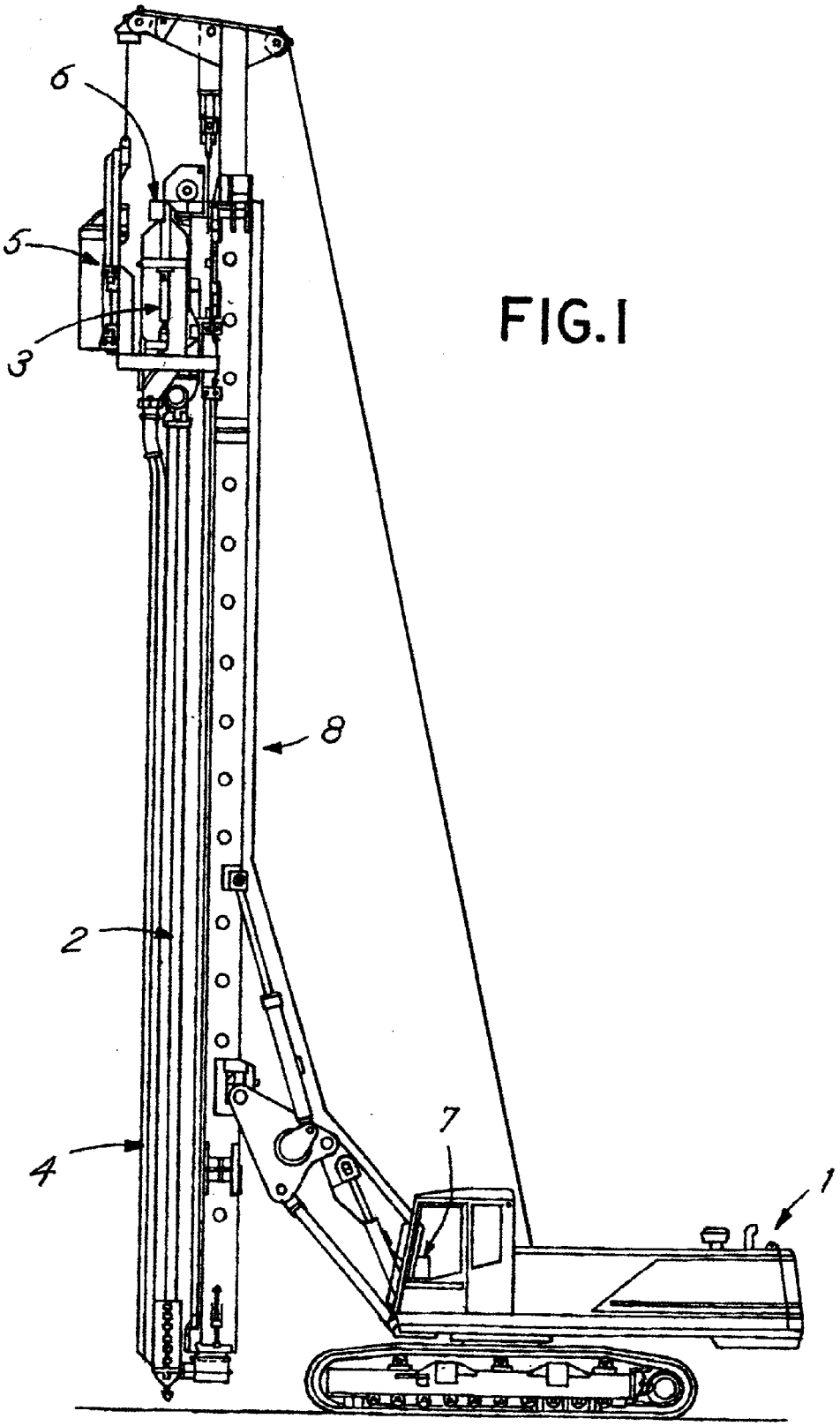
FIG. 1 is a diagrammatic view in elevation illustrating the monitor and display of the present invention.

The method of the present invention is described in conjunction with the vibratory probe illustrated in the drawings. Nevertheless, with regard to the method of the present invention for constructing compacted granular or stone columns in soil, it should be borne in mind that other types of probes may be employed as hereinbefore described.

Referring first to the probe as illustrated in FIG. 1, the probe is basically similar to the type of vibratory probe illustrated in Mars U.S. Pat. No. 4,126,007 and Goughnour U.S. Pat. No. 4,397,588 with some novel improvements. The vibratory probe 2 is vertically raised and lowered by any conventional means such as crane 1.

The probe 2 is penetrated into the soil to a predetermined depth under its own weight and with vibration and assistance of a jetting fluid. At the required depth, the probe 2 is slowly retrieved in 1 ft. to 2 ft. increments to allow backfill placement beneath the withdrawn tip of the probe. Granular material is transported to the probe 2 tip through a transfer pipe 4 that runs parallel to the probe down to the tip. The transfer pipe 4 is fed by a material container 3, typically mounted at the top of the probe assembly. As the probe 2 is withdrawn, the granular material is fed into the void at the probe tip. The probe 2 is partially lowered again, forcing the freshly deposited granular material into the surrounding soil with the assistance of vibration, thereby creating compaction of the newly placed granular material.

Figure 2:
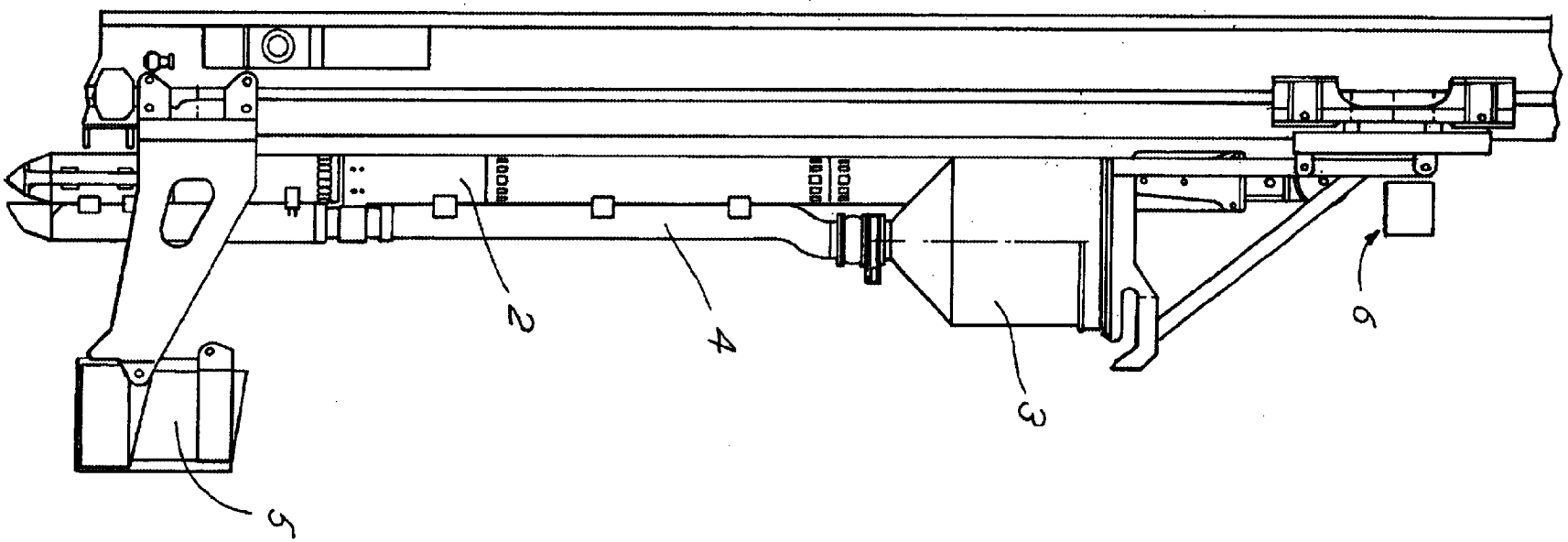
FIG. 2 is an enlarged view in elevation of the monitor position illustrated in FIG. 1.

The present invention improves the construction procedure by allowing the operator to continuously monitor the flow of material from the material container 3 to the stone column, thus guaranteeing a continuous stone column formation in a more time-efficient manner. Referring to FIG. 2, a monitor, or camera, 6 is positioned such that the quantity of granular material in the material container 3 can be observed in a real-time manner on a display 7 visible to the crane operator in the cab of the crane 1.

In the preferred embodiment, a closed circuit television system is employed and the monitor 6 is a video camera. The operator can observe the quality and quantity, or flow rate, of granular material in the material container 3 on a television screen display 7 in the cab of the crane 1. A closed circuit television system requires a cable 8 to connect the camera 6 and display 7. Note, however, that any alternative embodiment that allows the operator to visually observe the quantity of granular material in the material container 3 in a real-time manner that may or may not require a cable 8 would be encompassed by this improvement. The camera 6 is mounted above the material container 3 such that the entire container and the quantity of material therein are visible to the operator at all times on the screen display. Because of the nature of the operation being monitored, which may involve thrown granular material, the monitor 6 should have either a damage resistant lens, or a shield of some sort. For similar reasons, the use of a closed-circuit system that necessitates a cable 8 connection requires protection of the cable from thrown material and debris. Also, since the container 3 is typically frusto-conical in configuration with an open top, camera 6 is preferably mounted by means of a bracket 10 above and generally adjacent to the container 3 so that granular material may be continuously or intermittently fed into the container 3 in response to control signals from an operator in the cab of the crane 1. The camera 6 and container 3 are both mounted on the rail assembly enabling the container 3, probe 2, and camera 6 to move, in unison, upwardly or downwardly. The transfer hopper 5 moves independently of the container 3 so as to transport granular material to the container 3, and tilt to dump granular material into the container 3. The camera 6 is thus positioned vertically above the container 3 by a distance that exceeds the extent that the transfer hopper 5 extends above the top edge of the container 3. In this manner, the level of stone in the container 3 is observable at all times even during filling of the container 3 by the transfer hopper 5. Functionally, observations of the need to fill the container 3, the extent of filling of the container 3 by the transfer hopper 5, and the quantity of material in the transfer hopper are observable.

Real-time visual monitoring of the quantity of granular material in the material container 3 eliminates the need for the operator to fully withdraw the probe 2 from the ground to examine whether the granular material is continuously flowing. As the material container 3 is emptied, the operator can refill the material container 3 using the transfer hopper 5 as necessary. Furthermore, the operator can measure the rate of flow of granular material into the stone column based upon the rate at which material container 3 emptied. Rate calculations can be completed by at least two methods. First the operator can measure the time for the full material container 3 to empty during the construction of the stone column. Alternatively, the inside of the material container can be marked in any appropriately durable manner such that the operator can measure the time required to empty any measured portion of the material container.

Figure 3:
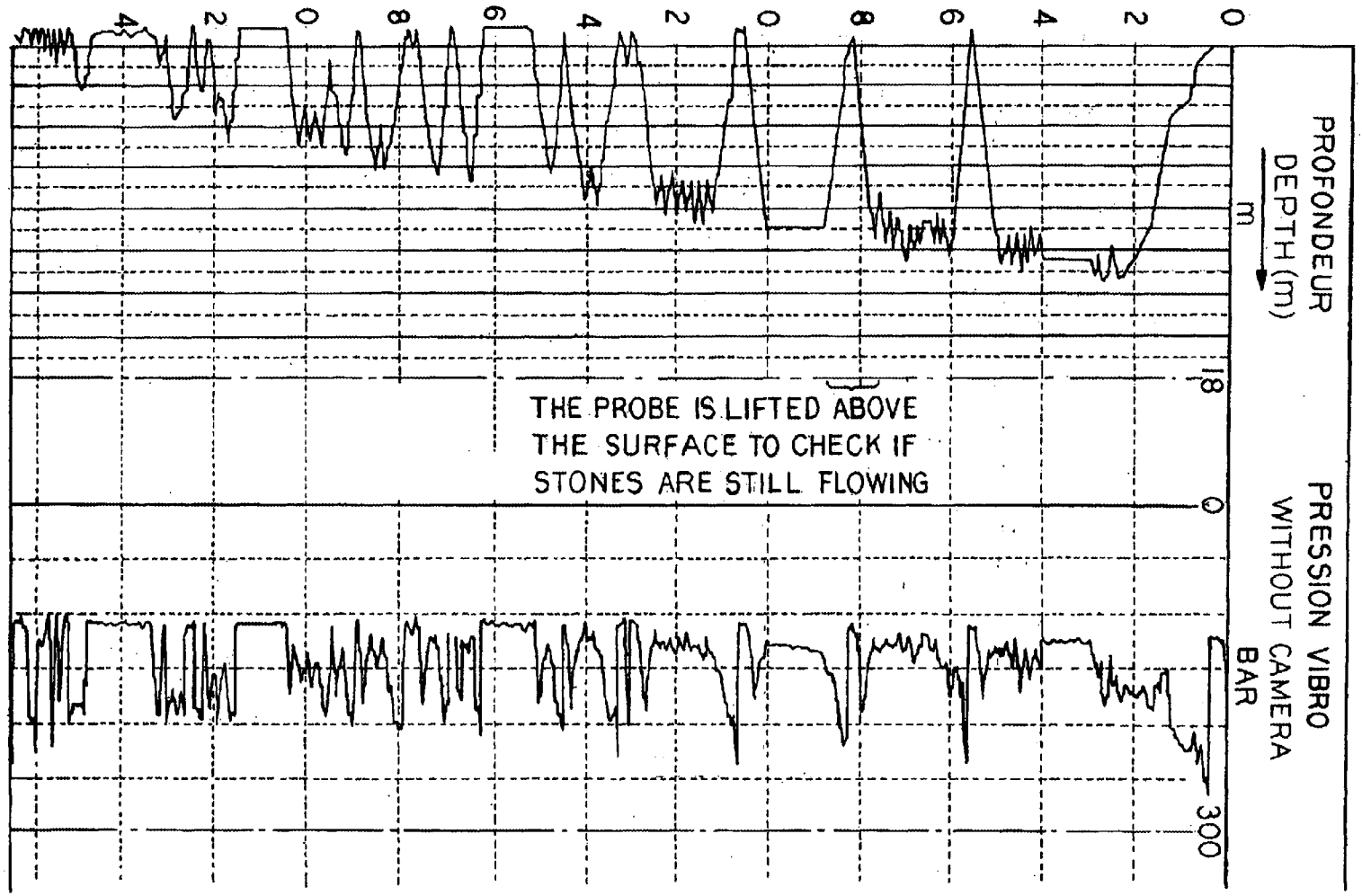
FIG. 3 is a graphical representation of the position and penetration resistance of the vibratory probe during construction of a stone column without the use of the monitor.
Figure 4:
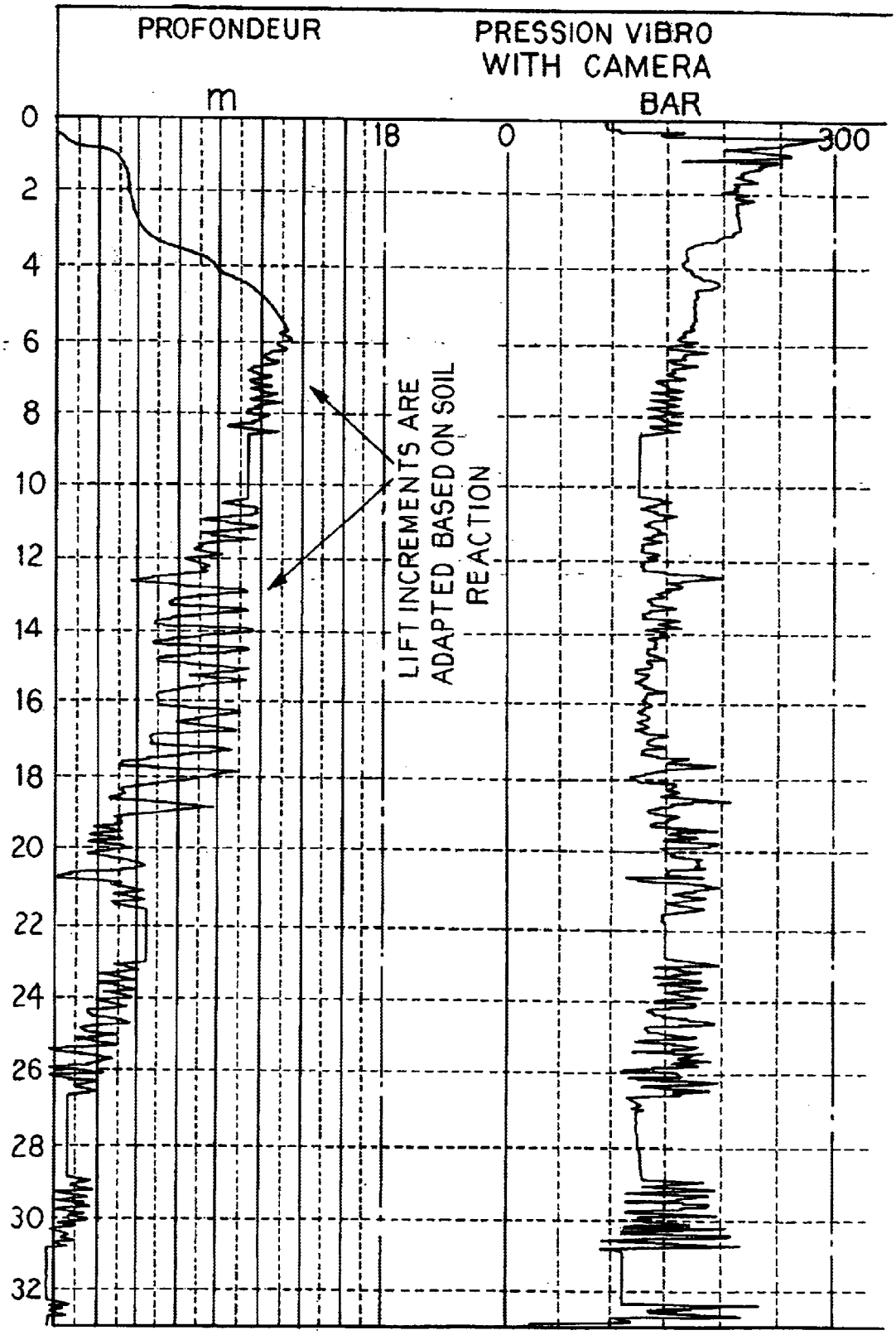
FIG. 4 is a graphical representation of the position and penetration resistance of the vibratory probe during construction of a stone column when a monitor is used by the operator.

FIGS. 3 and 4 present graphical representations of the depth and penetration resistance of the vibratory probe 2 when a monitor 6 is used by the operator, compared to when a monitor 6 is not used. In FIG. 3, it can be observed that the vibratory probe 2 must be fully extracted from the soil periodically to determine whether granular material is flowing through the transfer pipe 4. FIG. 3 also shows the resulting increase in penetration resistance when the vibratory probe 2 is reinserted. FIG. 4 shows how the use of a monitor 6 eliminates the need to fully extract the vibratory probe 2 for examination. In FIG. 4, the vibratory probe 2 lift increments are based on the soil response rather than the need to examine the equipment. FIG. 4 further shows that the use of a monitor eliminates the spike in vibratory probe 2 penetration resistance resulting from reinsertion. As a result, the status of the amount of granular material in the container 3 is evaluated and known at all times during the stone column formation without stopping the column formation process to fill the container 3. As stated previously, column formation time is reduced by 20% as a result of the improved efficient and reduction of work and energy of reinserting the probe 2.

Variations of the equipment may be adapted without departing form the spirit and scope of the invention. Thus, the invention is to be limited only by the following claims and equivalents thereof.

We claim:

1. An apparatus for visually monitoring the flow of material into a stone column from a material container feeder for the purpose of constructing a compacted granular or stone column in soil consisting of: (a) a penetrating vibratory probe mechanism; (b) a bottom feeding transfer pipe connected to said probe mechanism; (c) a material container that feeds the transfer pipe; and (d) a means for visually monitoring the quantity of granular material in the material container in real-time by the operator.

2. The apparatus of claim 1 where said means for visually monitoring is a real-time visual display.

3. The apparatus of claim 1 where said means for monitoring is a closed-circuit television system.

4. The apparatus of claim 2 or 3 where the means for monitoring is mounted above and generally adjacent to the material container.

5. The apparatus of claim 2 or 3 where the means for monitoring and the material container are fixedly attached to the vibratory probe mechanism.

6. The apparatus of claim 5 where the material container may be filled with granular material from a transfer hopper that is independent of the vibratory probe mechanism.

7. The apparatus of claim 6 where the means for monitoring is mounted above and generally adjacent to the material container, without interfering with the transfer hopper.

8. A method for visually monitoring the flow of material in a stone column construction comprising the steps of penetrating a vibratory probe downwardly into the soil to be compacted to a predetermined depth thereby forming an elongated cavity in the soil, partially withdrawing the probe from the soil cavity, backfilling at least a portion of the cavity with granular material from a material container that feeds the granular material to the tip of the probe providing a means for continuously monitoring the quantity of material in the material container and refilling the material container as necessary so that the flow remains uninterrupted and the probe need never be fully withdrawn for inspection, and compacting the granular material in the cavity to form a compacted column.

9. The method of claim 8 wherein the means for continuously monitoring the quantity of material in the material container is a closed circuit television system.

10. The method of claim 8 wherein the quantity of flow of the material in the formation of the stone column is measured by visually monitoring in real-time the change in quantity of material in the container.

11. The method of claim 10 wherein means for continuously monitoring the quantity of material in the material container is a closed circuit television system.

12. The apparatus of claim 1 where the material container that feeds the transfer pipe is at least in part positioned directly vertically over the transfer pipe to feed material at least in part directly vertically into the transfer pipe.

13. An apparatus for visually monitoring the flow of material into a stone column from a material container feeder for the purpose of constructing a compacted granular or stone column in soil consisting of: (a) a penetrating vibratory probe mechanism; (b) a bottom feeding transfer pipe connected to said probe mechanism; (c) a material container positioned at least in part directly over the transfer pipe to feed material at least in part directly vertically into the transfer pipe; and (d) a material container observation mechanism for monitoring the quantity of granular material in the material container in real-time by the operator.

* * * * *